US008059072B2

(12) United States Patent
Wu

(10) Patent No.: US 8,059,072 B2
(45) **Date of Patent: *Nov. 15, 2011**

(54) PIXELS, DISPLAY DEVICES UTILIZING SAME, AND PIXEL DRIVING METHODS

(75) Inventor: Kuan-Long Wu, Kaohsiung County (TW)

(73) Assignee: Au Optronics Corp., Hsinchu (TW)

( * ) Notice: Subject to any disclaimer, the term of this patent is extended or adjusted under 35 U.S.C. 154(b) by 840 days.

This patent is subject to a terminal disclaimer.

(21) Appl. No.: 12/103,058

(22) Filed: Apr. 15, 2008

(65) Prior Publication Data

US 2008/0192036 A1 Aug. 14, 2008

Related U.S. Application Data

(63) Continuation of application No. 10/994,058, filed on Nov. 19, 2004, now Pat. No. 7,400,309.

(30) Foreign Application Priority Data

Jun. 11, 2004 (TW) ..... 93116844 A

(51) Int. Cl.
*G09G 3/32* (2006.01)
*G09G 3/30* (2006.01)

(52) U.S. Cl. ..... 345/82; 345/76

(58) Field of Classification Search ..... 345/76–83
See application file for complete search history.

(56) References Cited

U.S. PATENT DOCUMENTS 7,173,585 B2 2/2007 Weng

*Primary Examiner* — Bipin Shalwala
*Assistant Examiner* — Steven Holton
(74) *Attorney, Agent, or Firm* — Thomas|Kayden

(57) ABSTRACT

A pixel including a light-emitting element, a driving transistor, a maintain capacitor, a switch device, and a control device. The driving transistor is serially coupled to the light-emitting element for driving the light-emitting element to emit light and has a threshold voltage and a gate connected to a point. A first terminal of the maintain capacitor is connected to the point. The switch device is controlled by a scan signal and connected between a data line and the point. The control device is connected to a second terminal of the maintain capacitor. When the switch device is turned off, the control device provides a first control voltage, the value of which is determined by the threshold voltage, to the point through the maintain capacitor.

15 Claims, 7 Drawing Sheets

PIXELS, DISPLAY DEVICES UTILIZING SAME, AND PIXEL DRIVING METHODS

CROSS REFERENCE TO RELATED APPLICATIONS

This application is a Continuation of pending U.S. patent application Ser. No. 10/994,058, filed Nov. 19, 2004 and entitled "PIXELS, DISPLAY DEVICES UTILIZING SAME, AND PIXEL DRIVING METHODS".

BACKGROUND

The invention relates to a display device, and in particular to pixels within display devices.

In general, thin film transistors (TFTs) applied in panel display devices can be divided into two categories, amorphous silicon (a-Si) TFT and low temperature poly-silicon (LTPS) TFT. Electron mobility of the LTSP TFT is 100 times higher than that of the a-Si TFT, capable of outputting enough current to light an organic light-emitting diode (OLED). When the a-Si TFT generating insufficient current is applied in an active OLED, a large voltage must be supplied to the a-Si TFT for generating larger current, resulting in undesirable rapid quality degradation thereof. Thus, the LTPS TFT is often applied in active OLED display devices.

A conventional active OLED display device comprises a plurality of pixels, each pixel PIX shown in FIG. 1 is composed of at least two LTPS TFTs. A transistor T1 is serially coupled to a light-emitting device (LED) D between voltage sources $V_{dd}$ and $V_{ss}$. A gate of a transistor T2 receives a scan signal $V_{scan}$ through a signal line while a drain thereof receives a data signal $V_{data}$ through a data line. When the transistor T2 is turned on by scan data $V_{scan}$, data signal $V_{data}$ corresponding to the pixel PIX is transmitted to a gate of the transistor T1. When the pixel PIX is designed to emit light, the transistor T1 is turned on by the potential of the data signal $V_{data}$ and generates a driving current I, so that the LED D emits light. At the same time, a capacitor C stores a voltage $V_{gs}$ related to the driving current I. When the transistor T2 is turned off by the scan data $V_{scan}$, the transistor T1 continues generating the driving current I due to the voltage $V_{gs}$ of the capacitor C, so that the LED D continues to emit light.

In the LTPS TFT fabrication process, a crystal step is performed with a laser. Since the width of the laser beam is limited, the laser is not able to irradiate all TFTs at a time. Thus, by repeating the crystal step, each TFT can be irradiated.

The intensity of each leaser beam, however, differs, and the TFTs irradiated by different leaser beams have different threshold voltages. If the threshold voltages of the transistors T1 within all pixel PIX drifts, the driving currents I generated by the transistors T1 are differ, resulting in non-uniform brightness. Thus, it is difficult to design a display panel capable of uniformly emitting light with pixel circuit in FIG. 1.

Additionally, each pixel is coupled to the voltage source $V_{dd}$ through a power line. The longer the power line, the larger the parasitical resistance thereof. Thus, pixels near the voltage source $V_{dd}$ are brighter, while pixels farther from the voltage source $V_{dd}$ are darker.

SUMMARY

Pixels are provided. An exemplary embodiment of a pixel comprises a light-emitting element, a driving transistor, a maintain capacitor, a switch device, and a controller. The driving transistor is serially connected to the light-emitting element for driving the light-emitting element to emit light and has a threshold voltage and a gate coupled to a point. The maintain capacitor has a first terminal coupled to the point and a second terminal. The switch device is coupled between a data line and the point and turned on according to a scan signal. The controller is coupled to the second terminal of the maintain capacitor and provides a first control voltage determined by the threshold voltage, to the point via the maintain capacitor when the switch device is turned off.

Driving methods for light-emitting elements of pixels are provided. An exemplary embodiment of a driving method comprises following steps. First, a driving transistor is provided for serially coupling to the light-emitting element for driving the light-emitting element to emit light. The driving transistor has a threshold voltage and a gate coupled to a point. A first control voltage, the value of which is determined by the threshold voltage, is provided to regard the threshold voltage to the point when the pixel is not selected. A second control voltage is provided to the point when the pixel is selected. The second control voltage is not determined by the threshold voltage.

BRIEF DESCRIPTION OF THE DRAWINGS

Pixels, display devices utilizing same, and pixel methods will become more fully understood from the detailed description given hereinbelow and the accompanying drawings, given by way of illustration only and thus not intended to be limitative of the invention.

DETAILED DESCRIPTION

Figure 2:
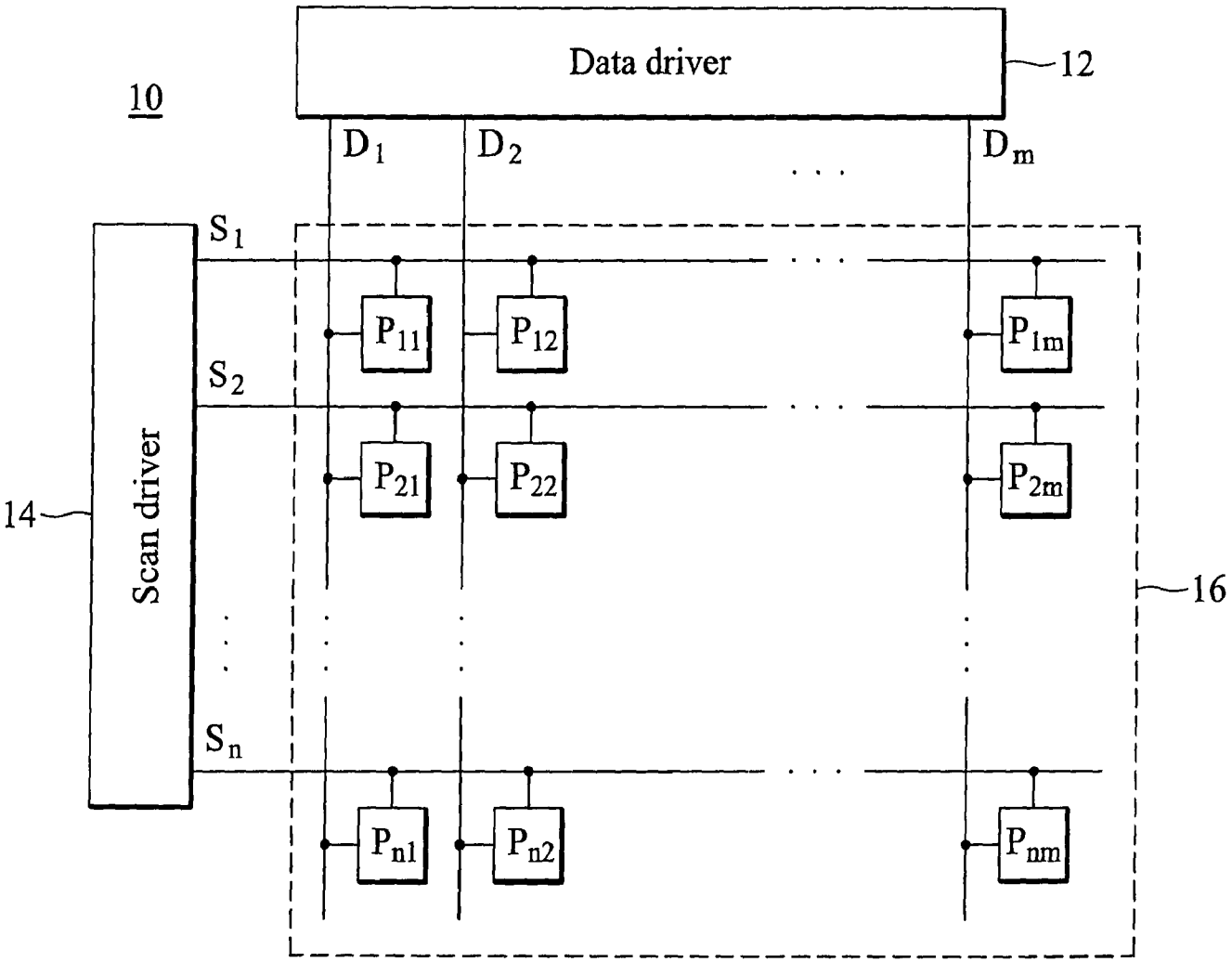
FIG. 2 is a block diagram of an embodiment of a display device.

Pixels and display devices are provided. In an exemplary embodiment, as shown in FIG. 2, a display device 10 comprises a data driver 12, a scan driver 14, and a display panel 16. The data driver 12 provides data signals to data lines $D_1$ to $D_m$, while the scan driver 14 provides scan signals to scan lines $S_1$ to $S_n$. The display panel 16 has a plurality of pixels $P_{11}$ to $P_{nm}$ disposed in a matrix configuration.

The pixels $P_{11}$ to $P_{nm}$ receive respective scan signals and data signals. For example, the pixel $P_{11}$ receives scan and data signals respectively through the scan line $S_1$ and the data line $D_1$. All the pixels in one column can be turned on by the scan signal on the corresponding scan line, and the corresponding data signals are then transmitted to the pixels through the data lines $D_1$ to $D_m$.

Figure 3:
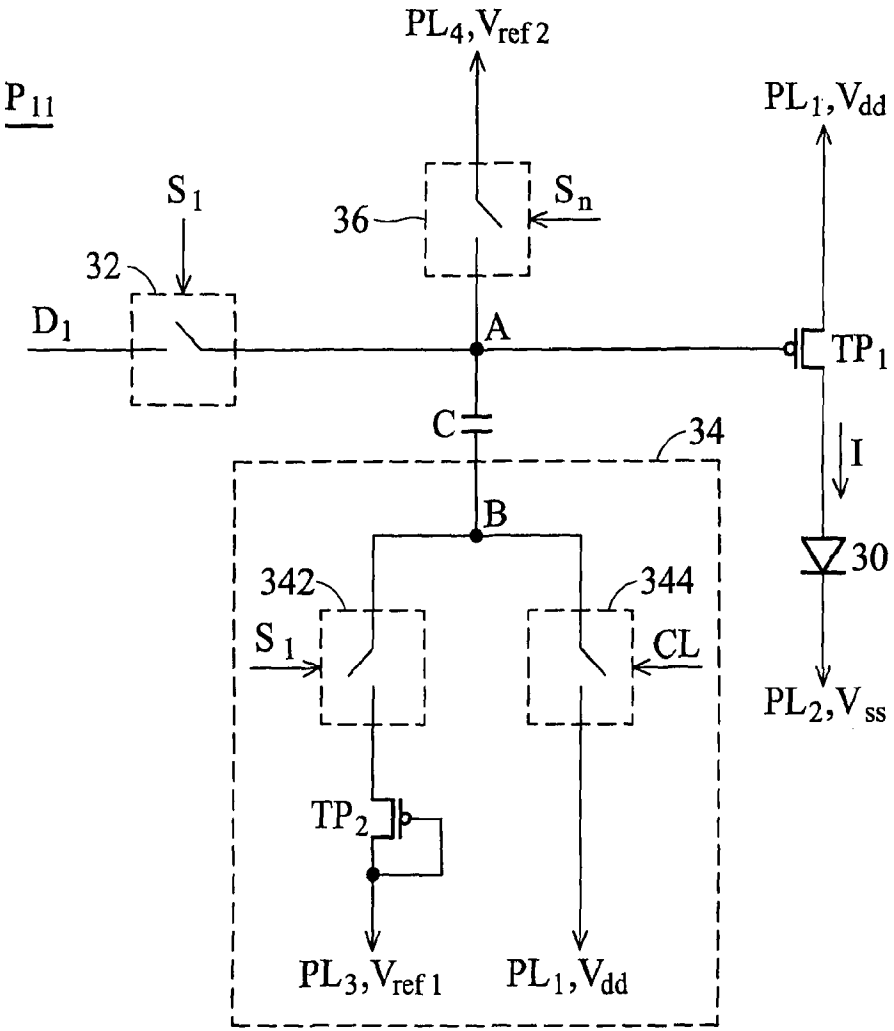
FIG. 3 shows an embodiment of a pixel of the display device in FIG.

In some embodiments, as shown in FIG. 3, the pixel $P_{11}$, as with any other pixel, comprises a light-emitting element 30, a driving transistor $TP_1$, a maintain capacitor C, a switch device 32, and a controller 34.

The light-emitting element 30 is coupled to the driving transistor $TP_1$ between power lines $PL_1$ and $PL_2$. The driving transistor $TP_1$ has a threshold voltage $V_{tp1}$ and its gate is coupled to a node A. In FIG. 3, light-emitting element 30 is an OLED or a polymer light-emitting diode (PLED). Power lines $PL_1$ and $PL_2$ are respectively coupled to a high voltage source $V_{dd}$ and a low voltage source $V_{ss}$.

The switch device 32 is coupled between the data line $D_1$ and the node A. The switch device 32 is turned on by the scan signal on the scan line $S_1$ and then transmits the data signal on the data line $D_1$ to the node A. The maintain capacitor C is coupled between the node A and the controller 34.

The controller 34 comprises switches 342 and 344 and MOS diode $TP_2$. The MOS diode $TP_2$ has a threshold voltage $V_{tp2}$ and is coupled to the switch 342 between a node B and a power line $PL_3$. The power line $PL_3$ is coupled to a voltage source $V_{ref1}$. The switch 344 is coupled between the node B and the power line $PL_1$. If a P-type TFT serves as the MOS diode $TP_2$, a gate and a drain of the p-type TFT are coupled to the power line $PL_3$ and a source thereof is coupled to the switch 342.

The switch 342 is controlled by the scan signal on the scan line $S_1$. When the switch device 32 is turned on, the switch 342 is also turned on. The switch 344 is controlled by a control signal on a control line CL.

In an embodiment as shown in FIG. 3, the switches 342 and 344 are not turned on at the same time. When both switches 342 and 344 are n-type or p-type TFTs, the control signal on the control line CL and the scan signal on the scan line $S_1$ are out of phase for preventing the switches 342 and 344 from being simultaneously turned on. When types of switches 342 and 344 are different, the control signal on the control line CL and the scan signal on the scan line $S_1$ are in phase.

It is assumed that the control signal on the control line CL and the scan signal on the scan line $S_1$ are out of phase. When the switch device 32 is turned on by the scan signal on the scan line $S_1$, a voltage $V_A$ at the node A is equal to the data signal on the data line $D_1$. At the same time, the switch 342 is also turned on, and a voltage $V_B$ at the node B is equal to ($V_{ref1}-V_{tp2}$). Thus, a voltage $V_C$ of the maintain capacitor C is represented by the following equation:

$$V_C=V_{data}-(V_{ref1}-V_{tp2}) \quad \text{(Equation 1)}$$

When the switch 32 is turned off by the scan signal on the scan line $S_1$, the switch 342 is turned off while the switch 344 is turned on. Thus, a voltage $V_C$ of the maintain capacitor C is represented by the following equation:

$$V_C=V_A-V_{dd} \quad \text{(Equation 2)}$$

The formula (1) is equal to the formula (2) due to charge conservation law of capacitors. Combining Equations 1 and 2 produces $$V_A-V_{dd}=V_{data}-(V_{ref1}-V_{tp2}) \quad \text{(Equation 3)}$$

$$V_A=V_{data}-(V_{ref1}-V_{tp2})+V_{dd} \quad \text{(Equation 4)}$$

A driving current I provided by the driving transistor $TP_1$ is represented by the following equation:

$$I\propto(V_{gs}-V_{tp1})^2$$

$$I\propto[(V_A-V_{dd})-V_{tp1}]^2 \quad \text{(Equation 5)}$$

Combining Equations 3 and 5 produces $$I\propto(V_{data}-V_{ref1}+V_{tp2}-V_{tp2})^2 \quad \text{(Equation 6)}$$

According to the Equation (6), the driving current I of the light-emitting element 30 is not influenced by the voltage $V_{dd}$. Since the positions of the transistors within the pixel are close to each other, their threshold voltages are almost equal. It is desired that the threshold voltage $V_{tp1}$ be equal to the threshold voltage $V_{tp2}$, so that the driving current I is not influenced by the threshold voltage $V_{tp1}$. Thus, non-uniform brightness of the light-emitting elements within the pixels due to different threshold voltages of the driving transistors therein is eliminated.

Since turn-on of the MOS diode is one way, when image data written into the pixel has a value smaller than previous image data, the MOS diode cannot be turned on and provide charge to the maintain capacitor C. In FIG. 3, a set device 36 is provided between the node A and a power line $PL_4$. The set device 36 pulls down the voltage $V_A$ at the node A before the image data is written, so that the maintain capacitor C is charged when the image data is written. In FIG. 3, a voltage source $V_{ref2}$ of the power line $PL_4$ is same as the voltage source $V_{ss}$ of the power line $PL_2$.

According to FIG. 3, when the controller 34 is turned on by the scan signal on the scan line $S_1$, the switch 342 is turned on, and the voltage $V_B$ at the node B is equal to ($V_{ref1}-V_{tp2}$). When the controller 34 is turned off by the scan signal on the scan line $S_1$, the switch 344 is turned on, and the voltage $V_B$ at the node B is equal to the voltage provided by the voltage source $V_{dd}$. As the above described, the variation of the voltage $V_B$ is determined by the threshold voltage $V_{tp2}$ of the MOS diode $TP_2$. According to the charge conservation law of the maintain capacitor C, the variation of the voltage $V_B$ is equal to that of the voltage $V_A$. Thus, the variation of the voltage $V_A$ is determined by the threshold voltage $V_{tp2}$ of the MOS diode $TP_2$.

Since the transistors within the pixel PIX are nearly equal, the threshold voltage $V_{tp1}$ is made equal to the threshold voltage $V_{tp2}$. In other words, the variation of the voltage $V_A$ is also determined by threshold voltage $V_{tp1}$ of the driving transistor $TP_1$.

Figure 4:
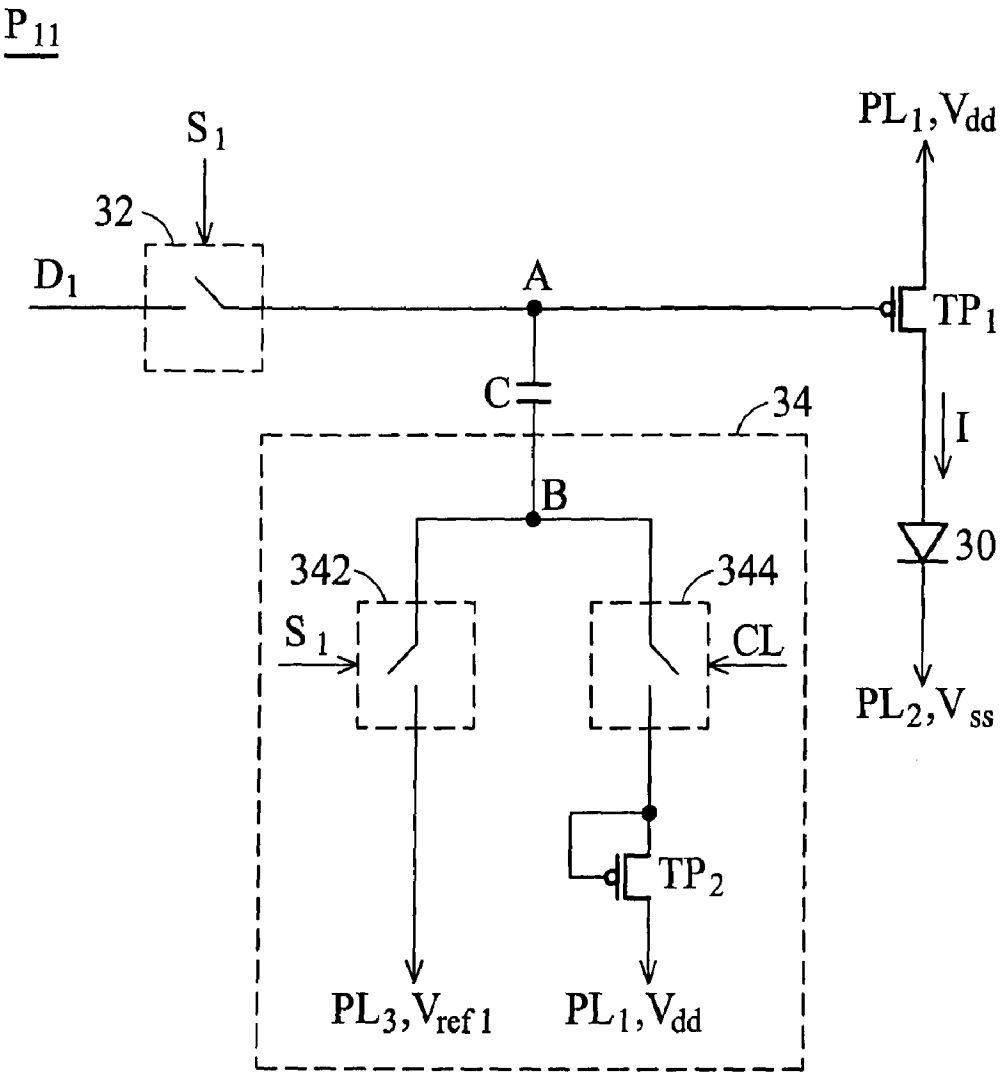
FIG. 4 shows an embodiment of a pixel of the display device in FIG.

In an embodiments of a pixel of a display panel, as shown in FIG. 4, the MOS diode $TP_2$ of the controller 34 is changed for coupling between the switch 344 and the power line $PL_1$. The operation of the pixel in FIG. 4 is the same as that in FIG. 3. In FIG. 4, since the voltage provided by the voltage source $V_{ref1}$ is smaller than the voltage provided by the voltage source $V_{dd}$, the voltage $V_B$ at the node B is latched by the MOS diode $TP_2$ when the switch 344 is turned on.

When image data is written, a terminal of the maintain capacitor C is coupled to the voltage source $V_{ref1}$ through the turned-on switch 342, enabling discharge of the maintain capacitor C.

Since one terminal of the maintain capacitor C in FIG. 3 is coupled to the voltage source $V_{ref1}$ through the turned-on switch 342 and the MOS diode $TP_2$, a set device 36 is required to discharge the maintain capacitor C. The terminal of the maintain capacitor C in FIG. 4, however, is only coupled to the voltage source $V_{ref1}$ through the turned-on switch 342 when image data is written, thus the maintain capacitor C can be discharged and the set drive is no longer required as shown in FIG. 4.

When the switch device 32 is turned on by the scan signal on the scan line $S_1$, the switch 342 is turned on and the voltage $V_B$ at the node B is equal to the voltage provided by the voltage source $V_{ref1}$. When the switch device 32 is turned off by the scan signal on the scan line $S_1$, the switch 344 is turned on and the voltage $V_B$ at the node B is equal to ($V_{dd}+V_{tp2}$). According to the charge conservation law, applied to maintain capacitor C, the variation of the voltage $V_B$ is equal to that of the voltage $V_A$.

When the switch device 32 is turned off, the voltage $V_B$ at the node B regards the threshold voltage $V_{tp2}$ of the MOS diode. Thus, the voltage $V_A$ is determined by the threshold voltage $V_{tp2}$. Since the positions of the transistors in the pixel are near, their threshold voltage is almost equal. It is desired that the threshold voltage $V_{tp1}$ is equal to the threshold voltage $V_{tp2}$, so that the voltage $V_A$ is also determined by the threshold voltage $V_{tp1}$.

Figure 5:
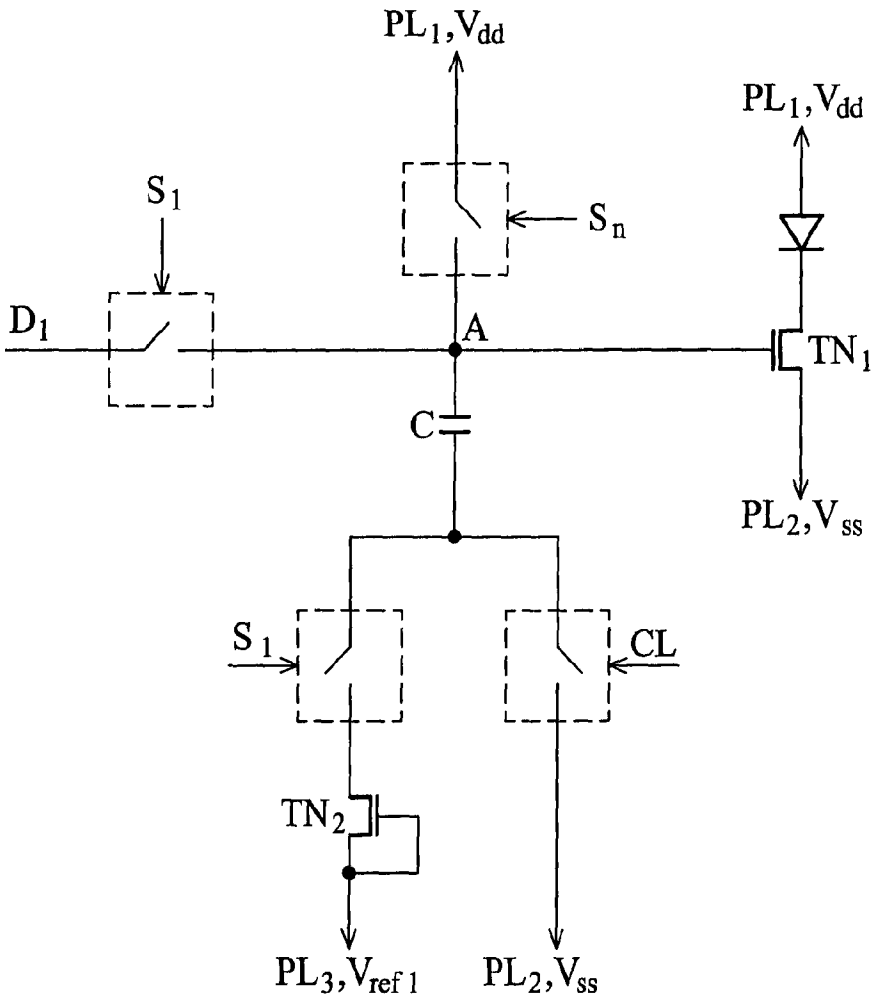
FIG. 5 shows an embodiment of a pixel of the display device in FIG.
Figure 6:
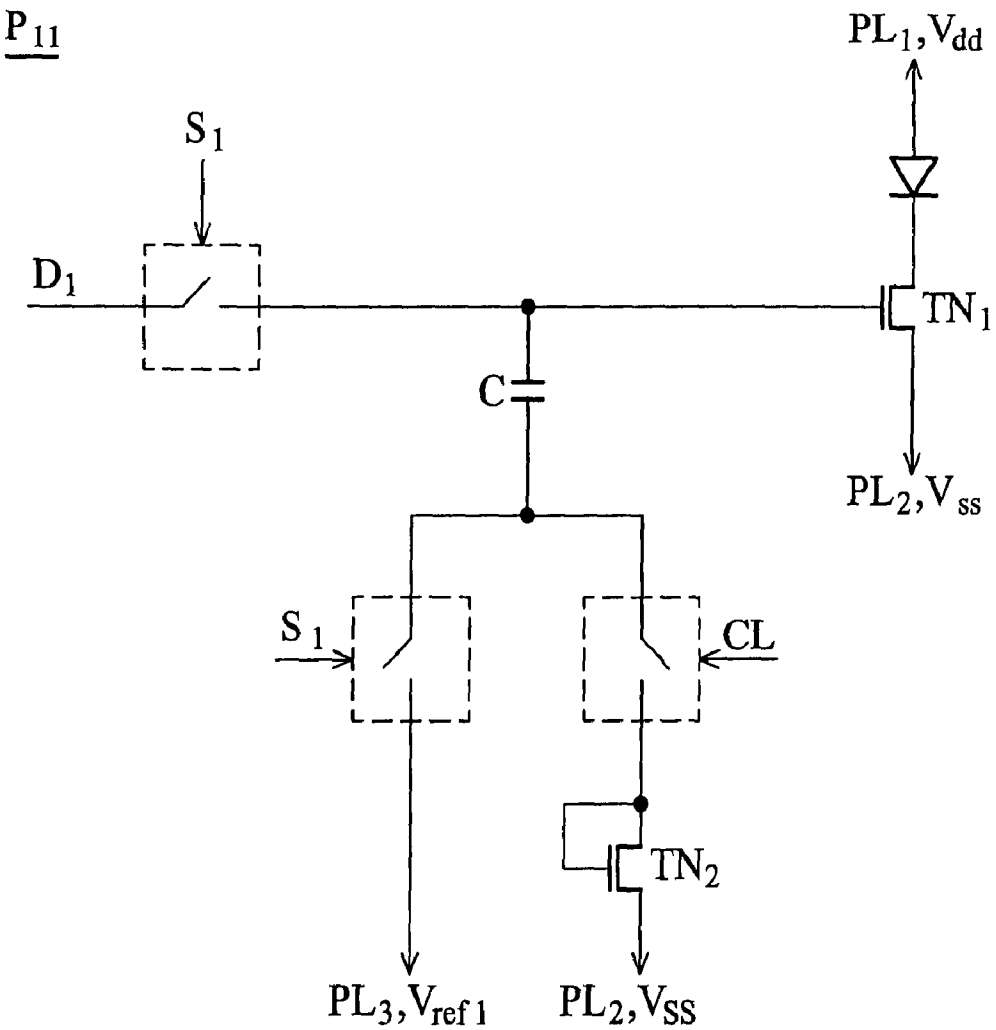
FIG. 6 shows an embodiment of a pixel of the display device in FIG.

In some embodiments, as shown in FIGS. 5 and 6, N-type pixel structures are provided and respectively correspond to FIGS. 3 and 4.

Figure 1:
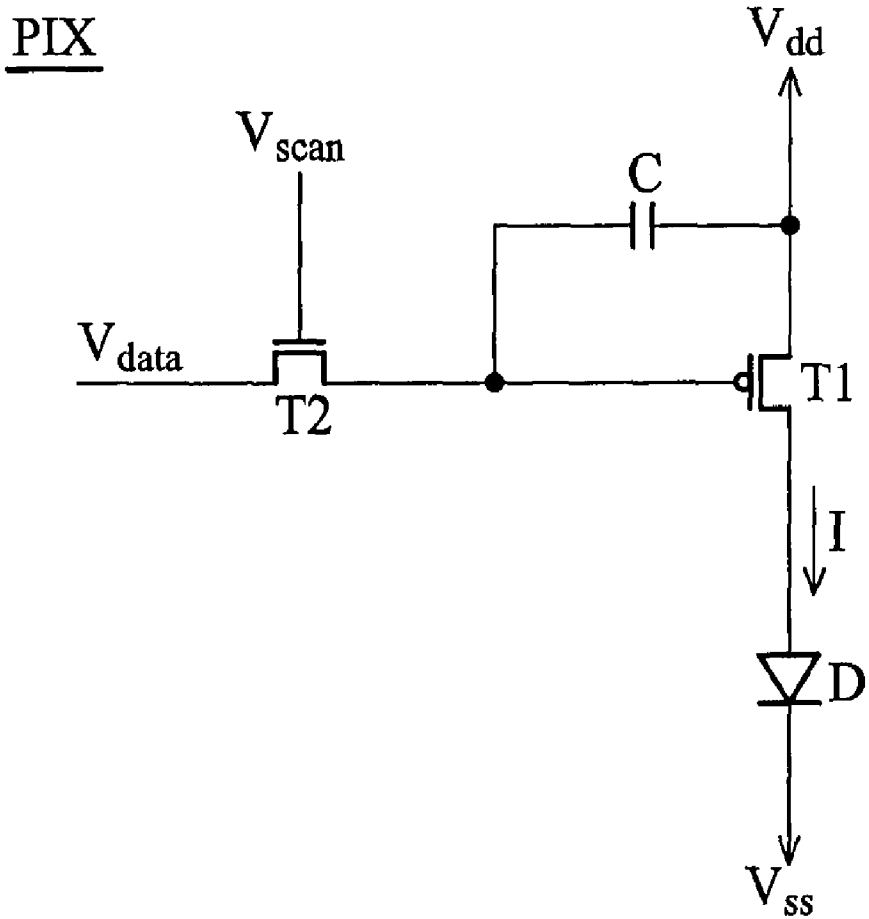
FIG. 1 (RELATED ART)
FIG. 1 shows a conventional pixel.

To prove that some embodiments of pixels prevent the driving currents of light-emitting elements therein from serious undesirable effects caused by the voltage source $V_{dd}$ and the threshold voltage of the driving transistor, the conventional pixel of FIG. 1 is compared with the embodiments of pixels, as shown in FIG. 4.

In FIG. 1, the voltage source $V_{dd}$ is set to 5V, the voltage source $V_{ss}$ is set to −12V, the threshold voltage $V_{tp1}$ of the transistor T1 is set to −1 V, and the data signal $V_{data}$ on the data line is set to 1.195V. In FIG. 4, the voltage source $V_{dd}$ is set to 5V, the voltage source $V_{ss}$ is set to −12V, the voltage source $V_{ref1}$ is set to 3V, and the threshold voltage $V_{tp1}$ of the transistor $TP_1$ is set to −1 V. The driving current in FIG. 4 is made equal to that in FIG. 1 by setting the data signal $V_{data}$ on the data line $D_1$ to 0V.

When the threshold voltage $V_{tp2}$ of the MOS diode $TP_2$ is equal to the threshold voltage $V_{tp1}$ of the driving transistor $TP_1$, the driving currents in FIGS. 2 and 4 are shown in Table 1.

TABLE 1

| | The driving current in FIG. 1 | The driving current in FIG. 4 |
|---|---|---|
| $V_{tp1} = -1$ V; $V_{dd} = 5$ V | $I \approx 1.2 \times 10^{-7}$ A | $I \approx 1.2 \times 10^{-7}$ A |
| $V_{tp1} = -0.5$; $V_{dd} = 5$ V | $I \approx 2.28 \times 10^{-7}$ A | $I \approx 1.33 \times 10^{-7}$ A |
| $V_{tp1} = -1$; $V_{dd} = 5.5$ V | $I \approx 2.3 \times 10^{-7}$ A | $I \approx 1.35 \times 10^{-7}$ A |

When the threshold voltage $V_{tp1}$ is changed, the difference rate of the driving current in FIG. 1 is about $$90\%\left(= \frac{2.28\times10^{-7} - 1.2\times10^{-7}}{1.2\times10^{-7}} \times 100\%\right),$$

and that in FIG. 4 is about 10%. When the voltage source $V_{dd}$ is changed, the difference rate of the driving current in FIG. 1 is about 91.7%, and that in FIG. 4 is about 12.5%. Accordingly, the driving current in FIG. 4 is not changed by a wide margin when the threshold voltage $V_{tp1}$ or voltage source $V_{dd}$ is changed.

Figure 7:
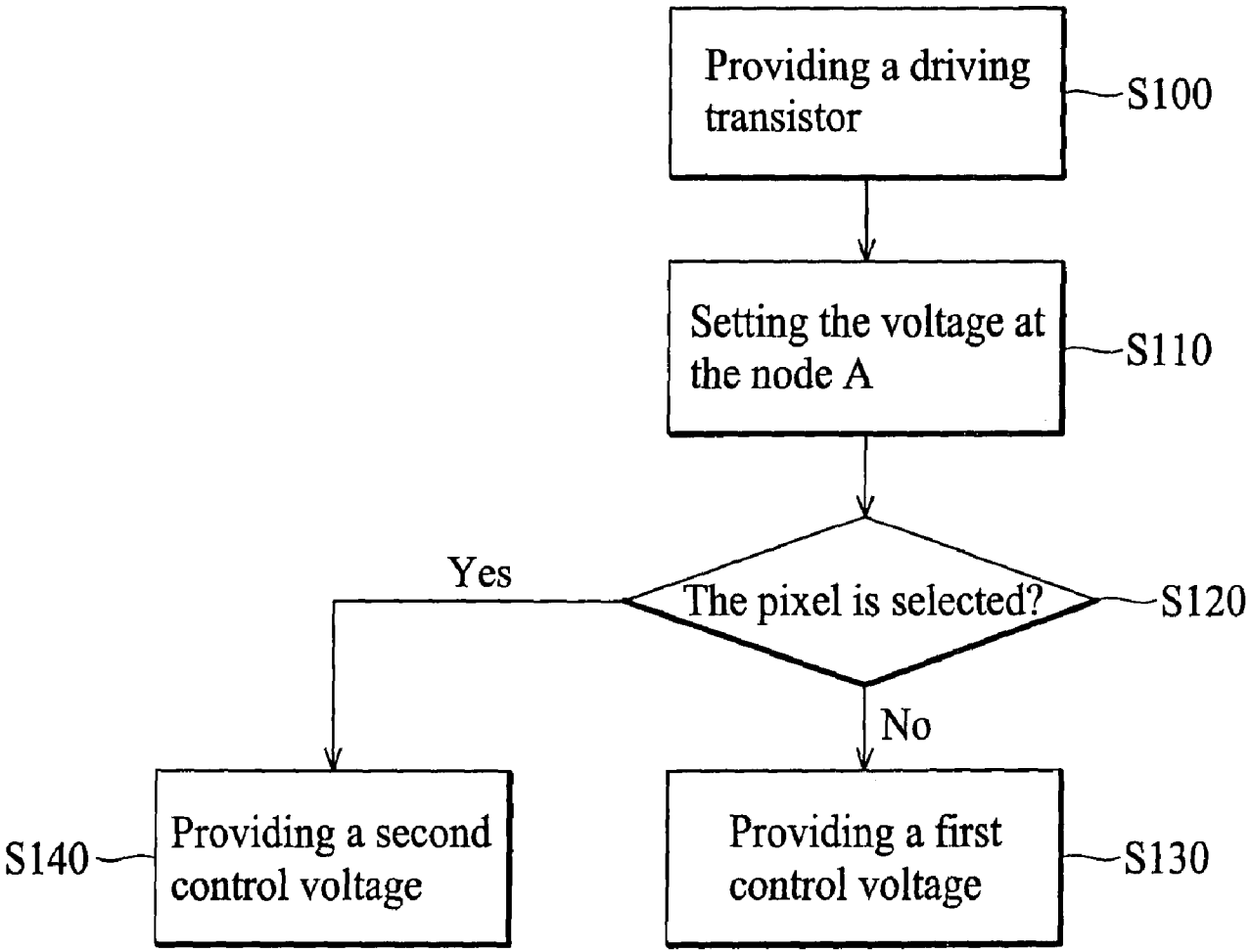
FIG. 7 is a flow chart of an embodiment of a pixel driving method.

FIG. 7 is a flow chart of a driving method of an embodiment of a pixel. Referring to FIGS. 3 and 7, first, the driving transistor $TP_1$ is provided for serially coupling to the light-emitting element 30 between the high voltage source $V_{dd}$ and the low voltage source $V_{ss}$ for providing the driving current I of the light-emitting element 30 (step S100). The driving transistor $TP_1$ has a threshold voltage $V_{tp1}$. The set device 36 then sets the voltage $V_A$ at the node A to latch the voltage $V_B$ at the node B (step S110).

It is determined whether the pixel $P_{11}$ is selected (step 120). When the pixel $P_{11}$ is not selected (step S130), the switch device 32 is turned off. According Equation (4), the voltage $V_A$ at the node A regards the threshold voltage $V_{tp2}$ of the MOS diode $TP_2$ and the threshold voltage $V_{tp1}$ of the driving transistor $TP_1$. Moreover, the voltage $V_A$ at the node A is determined by the high voltage source $V_{dd}$. When the pixel $P_{11}$ is selected (step S140), the switch device 32 is turned on. The voltage $V_A$ at the node A is equal to the data signal on the data line $D_1$ and is not determined by the threshold voltage $V_{tp1}$ of the driving transistor $TP_1$.

Since a gate voltage of the driving transistor $TP_1$ is not fixed, the influence of the high voltage source $V_{dd}$ on the driving current I can be degraded by the variation of the voltage $V_A$ at the node A. Moreover, when the pixel is not selected, the voltage $V_A$ at the node A regards the threshold voltage $V_{tp1}$ of the driving transistor $TP_1$, so that the threshold voltage $V_{tp1}$ as less influence on the driving current I.

While the invention has been described by way of preferred embodiment, it is to be understood that the invention is not limited thereto. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A pixel comprising:

a light-emitting element;

a driving transistor serially connected to the light-emitting element for driving the light-emitting element to emit light, wherein the driving transistor has a threshold voltage and a gate coupled to a point;

a maintain capacitor having a first terminal coupled to the point and a second terminal;

a switch device coupled between a data line and the point and turned on according to a scan signal; and a controller coupled to the second terminal of the maintain capacitor and providing a first control voltage, determined by the threshold voltage, to the second terminal, wherein the controller comprises:

a first switch; and a MOS diode serially coupled to the first switch between the second terminal of the maintain capacitor and a first reference power line, wherein the first switch is turned on when the switch device is turned on.

2. The pixel as claimed in claim 1, wherein the light-emitting element comprises an organic light emitting diode (OLED).

3. The pixel as claimed in claim 1, wherein the first control voltage is determined by the threshold voltage and a power coupled to a source of the driving transistor.

4. The pixel as claimed in claim 1, wherein the controller further comprises a second switch coupled between the second terminal of the maintain capacitor and a first power line and turned on when the switch device is turned off.

5. The pixel as claimed in claim 4, wherein the MOS diode is a p-type thin film transistor having a source coupled to the first switch, and a gate and a drain both coupled to the first reference power line.

6. The pixel as claimed in claim 4, wherein the MOS diode is a n-type thin film transistor having a source coupled to the first switch, and a gate and a drain both coupled to the first reference power line.

7. The pixel as claimed in claim 1, further comprising a set device for setting the voltage at the point before the switch device is turned on.

8. A pixel comprising:

a light-emitting element;

a driving transistor serially connected to the light-emitting element for driving the light-emitting element to emit light, wherein the driving transistor has a threshold voltage and a gate coupled to a point;

a maintain capacitor having a first terminal coupled to the point and a second terminal;

a switch device coupled between a data line and the point and turned on according to a scan signal; and a controller coupled to the second terminal of the maintain capacitor and providing a first control voltage, determined by the threshold voltage, to the second terminal, wherein the controller comprises:

a first switch; and a MOS diode serially coupled to the first switch between the second terminal of the maintain capacitor and a first power line, wherein the first switch is turned on when the switch device is turned off.

9. The pixel as claimed in claim 8, wherein the light-emitting element comprises an organic light emitting diode (OLED).

10. The pixel as claimed in claim 8, wherein the first control voltage is determined by the threshold voltage and a power coupled to a source of the driving transistor.

11. The pixel as claimed in claim 8, wherein the controller further comprises a second switch coupled between the second terminal of the maintain capacitor and a first reference power line and turned on when the switch device is turned on.

12. The pixel as claimed in claim 11, wherein the MOS diode is a p-type thin film transistor having a source coupled to the first power line, and a gate and a drain both coupled to the first switch.

13. The pixel as claimed in claim 12, wherein the first power line provides a high voltage.

14. The pixel as claimed in claim 11, wherein the MOS diode is a n-type thin film transistor having a source coupled to the first power line, and a gate and a drain both coupled to the first switch.

15. The pixel as claimed in claim 14, wherein the first power line provides a low voltage.

* * * * *